US007467661B2

(12) United States Patent
Gordon et al.

(10) Patent No.: US 7,467,661 B2
(45) Date of Patent: Dec. 23, 2008

(54) DOWNHOLE PERFORATOR ASSEMBLY AND METHOD FOR USE OF SAME

(75) Inventors: Scott Alistair Gordon, County Down (IE); Tom Chandler, Wasilla, AK (US); John Waddington, Uhrichsville, OH (US); Johnny Mack Dove, Collinsville, TX (US); William L. Vidrine, Houston, TX (US); Glen Hall, East Brewton, AL (US); Jack Gammill Clemens, Fairview, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 11/444,630

(22) Filed: Jun. 1, 2006

(65) Prior Publication Data

US 2007/0277980 A1 Dec. 6, 2007

(51) Int. Cl.
*E21B 43/112* (2006.01)

(52) U.S. Cl. ..... 166/298; 166/55.2; 166/55.7; 175/272; 175/273; 175/284

(58) Field of Classification Search ..... 166/55.2, 166/55.3, 55.6, 55.7, 298; 175/78, 272, 273, 175/284, 77
See application file for complete search history.

(56) References Cited

U.S. PATENT DOCUMENTS 2,091,680 A 8/1937 Greenlee
3,381,751 A 5/1968 McLelland
3,485,299 A 12/1969 Young
3,528,515 A * 9/1970 Garrison ..... 175/78
3,661,205 A 5/1972 Belorgey
4,007,797 A * 2/1977 Jeter ..... 175/26
4,094,359 A 6/1978 King
4,116,274 A 9/1978 Rankin et al.
4,124,070 A 11/1978 King et al.
4,185,705 A * 1/1980 Bullard ..... 175/78
4,243,099 A 1/1981 Rodgers, Jr.
4,687,054 A 8/1987 Russell et al.
4,955,951 A * 9/1990 Nemoto et al. ..... 166/55.7
5,069,282 A 12/1991 Taylor
5,070,941 A 12/1991 Kilgore (Continued)

FOREIGN PATENT DOCUMENTS

EP 0 5 11 789 A2 4/1992

(Continued)

*Primary Examiner*—Shane Bomar
(74) *Attorney, Agent, or Firm*—Lawrence R. Youst

(57) ABSTRACT

A downhole perforator assembly (10) for establishing communication between the interior of a tubular string (18) and a surrounding annulus (24) includes a downhole power unit (100) having a power unit housing (150) and a moveable shaft (130) and a downhole perforator (260) having a perforator housing (262), a mandrel (278) slidably positioned within the perforator housing (262) and a penetrator (288) radially outwardly extendable from the perforator housing (262). The power unit housing (150) is operably associated with the perforator housing (262) and the moveable shaft (130) operably associated with the mandrel (278) such that when the downhole power unit (100) is activated and the moveable shaft (130) is longitudinally shifted relative to the power unit housing (150), the mandrel (278) is longitudinally shifted relative to the perforator housing (262) and at least a portion of the penetrator (288) is extended radially outwardly from the perforator housing (262).

58 Claims, 6 Drawing Sheets

U.S. PATENT DOCUMENTS

| | | | | | |
|---|---|---|---|---|---|
| 5,103,903 | A | | 4/1992 | Marks, II | |
| 5,139,086 | A | | 8/1992 | Griffith, Sr. | |
| 5,197,773 | A | | 3/1993 | Vick, Jr. | |
| 5,228,507 | A | | 7/1993 | Obrejanu et al. | |
| 5,249,630 | A | * | 10/1993 | Meaders et al. | 166/373 |
| 5,267,613 | A | | 12/1993 | Zwart et al. | |
| 5,330,018 | A | | 7/1994 | Griffith | |
| 5,492,173 | A | | 2/1996 | Kilgore et al. | |
| 5,687,806 | A | * | 11/1997 | Sallwasser et al. | 175/62 |
| 5,692,565 | A | * | 12/1997 | MacDougall et al. | 166/264 |
| 5,775,443 | A | | 7/1998 | Hammett et al. | |
| 5,988,287 | A | | 11/1999 | Jordan, Jr. et al. | |
| 6,070,672 | A | | 6/2000 | Gazda | |
| 6,199,628 | B1 | | 3/2001 | Beck et al. | |
| 6,349,772 | B2 | | 2/2002 | Mullen et al. | |
| 6,502,638 | B1 | | 1/2003 | Stoesz | |
| 6,729,419 | B1 | | 5/2004 | Lee | |
| 7,051,810 | B2 | | 5/2006 | Clemens et al. | |
| 7,188,674 | B2 | * | 3/2007 | McGavern et al. | 166/298 |
| 7,367,397 | B2 | | 5/2008 | Clemens et al. | |
| 2004/0045714 | A1 | * | 3/2004 | McGavern et al. | 166/298 |
| 2005/0133224 | A1 | * | 6/2005 | Ruttley | 166/298 |
| 2007/0151731 | A1 | * | 7/2007 | Butler et al. | 166/298 |
| 2007/0151766 | A1 | * | 7/2007 | Butler et al. | 175/67 |

FOREIGN PATENT DOCUMENTS

| | | | |
|---|---|---|---|
| EP | 0 931 906 | A2 | 1/1999 |
| EP | 0 952 302 | A2 | 4/1999 |
| EP | 1 344 893 | A2 | 3/2003 |
| EP | 0 999 343 | B1 | 4/2004 |
| WO | WO 03/048511 | A1 | 6/2003 |
| WO | WO 2004/013457 | A2 | 2/2004 |

* cited by examiner

DOWNHOLE PERFORATOR ASSEMBLY AND METHOD FOR USE OF SAME

TECHNICAL FIELD OF THE INVENTION

This invention relates, in general, to establishing communication between the interior of a downhole tubular and the surrounding annulus and, in particular, to a downhole perforator assembly that is positioned at a target location in a well and operated to perforate a downhole tubular using a downhole power unit.

BACKGROUND OF THE INVENTION

A well intersecting a subterranean hydrocarbon bearing reservoir that has been producing for an extended period of time and whose flow rate has decreased or stopped altogether may require a workover. Workovers may include any of several operations on the well to restore or increase production once a reservoir stops producing at the desired rate. Many workover jobs involve treating the reservoir, while other workover jobs involve repairing or replacing downhole equipment. In order to keep a well under control while it is being worked over, a workover fluid in commonly circulated downhole. The workover fluid is typically a water-based or oil-based mud that includes a variety of additives to establish certain desirable properties such as high viscosity and the ability to form a wall cake to prevent fluid loss. Most importantly, the workover fluid must be of a sufficient weight to overcome formation pressure.

In certain well installations, prior to circulating workover fluid into the well, communication must be established between the interior of a tubular string, such as a casing, a liner, a tubing or the like and the annulus surrounding the tubular string. One method for establishing such communication is through the use of explosives, such as shaped charges, to create one or more openings through the tubular string. The shaped charges typically include a housing, a quantity of high explosive and a liner. In operation, the openings are made by detonating the high explosive which causes the liner to form a jet of particles and high pressure gas that is ejected from the shaped charge at very high velocity. The jet is able to penetrate the tubular string, thereby forming an opening.

As hydrocarbon producing wells are located throughout the world, it has been found that certain jurisdictions discourage or even disallow the use of such explosives. In these jurisdictions and in other locations where or when it is not desirable to use explosives, mechanical perforators have been used to establish communication between the interior of a tubular string and the surrounding annulus. Such mechanical perforators may, for example, include a radially extendable punch that penetrates through the tubular string. In operation, the mechanical perforator is typically coupled to wireline activated jarring tool and run downhole on a wireline or similar conveyance. Once the mechanical perforator is positioned at the target location in the well, the jarring tool is energized via wireline manipulation and the energy stored in the jarring tool is then exerted on the mechanical perforator causing the punch to shift radially outwardly.

It has been found, however, that the use of a wireline activated jarring tool to actuate a mechanical perforator may be unreliable. For example, such operations have failed to produce the desired openings in the tubular string and have instead only resulted in deformation of the tubular string. Accordingly, a need has arisen for a more reliable tool system for establishing communication between the interior of a tubular string the surrounding annulus without using explosives.

SUMMARY OF THE INVENTION

The present invention disclosed herein comprises a downhole perforator assembly and a method for using the downhole perforator assembly that are capable of establishing communication between the interior of a tubular string the surrounding annulus without using explosives.

In one aspect, the present invention is directed to a downhole perforator assembly including a downhole power unit having a power unit housing and a moveable shaft and a downhole perforator having a perforator housing, a mandrel slidably positioned within the perforator housing and a penetrator radially outwardly extendable from the perforator housing. In operation, the power unit housing is operably associated with the perforator housing and the moveable shaft is operably associated with the mandrel. Thereafter, when the downhole power unit is activated and the moveable shaft is longitudinally shifted relative to the power unit housing, the mandrel is longitudinally shifted relative to the perforator housing causing at least a portion of the penetrator to extended radial outwardly from the perforator housing.

In one embodiment, the downhole power unit includes a self-contained power source for providing electrical power to a microcontroller that controls the movement of the moveable shaft and an electric motor that operates a jackscrew assembly to impart longitudinal motion to the moveable shaft.

In one embodiment, the penetrator is a radial punch. In this embodiment, the mandrel includes a ramp that urges the penetrator radially outwardly relative to the perforator housing when the mandrel is longitudinally shifted relative the perforator housing. In another embodiment, the penetrator is a rotatable cutting member that is rotatably coupled to the mandrel. In this embodiment, the penetrator rotates and extends radially outwardly relative to the perforator housing when the mandrel is longitudinally shifted relative the perforator housing. In a further embodiment, the penetrator is a pair of oppositely disposed rotatable cutting members that are rotatably coupled to the perforator housing. In this embodiment, the mandrel includes a rack that mates with teeth of the penetrator such that the penetrator rotates and extends radially outwardly relative to the perforator housing when the mandrel is longitudinally shifted relative the perforator housing.

In another aspect, the present invention is directed to a method for perforating a tubular that includes providing a downhole power unit having a power unit housing and a moveable shaft, providing a downhole perforator having a perforator housing, a mandrel and a penetrator, operably associating the power unit housing to the perforator housing, operably associating the moveable shaft to the mandrel, activating the downhole power unit to longitudinally shift the moveable shaft relative to the power unit housing, thereby longitudinally shifting the mandrel relative to the perforator housing and responsive to the longitudinal shifting of the mandrel, radially extending at least a portion of the penetrator outwardly from the perforator housing.

In one embodiment, the step of activating the downhole power unit includes operating timing circuitry to provide a signal to a microcontroller after passage of a predetermined amount of time. In another embodiment, this step is accomplished by operating a pressure-sensitive switch to provide a signal to the microcontroller upon encountering a predetermined amount of pressure. In yet another embodiment, activation of the downhole power unit involves operating a motion sensor to provide a signal to the microcontroller upon encountering a predetermined motion state such as motionlessness.

In one embodiment, the step of radially extending at least a portion of the penetrator outwardly from perforator housing is preformed by radially outwardly urging the penetrator relative to the perforator housing with a ramp of the mandrel. In another embodiment, the penetrator is rotated relative to the mandrel. In a further embodiment, one or more penetrators are rotated relative to the perforator housing.

In a further aspect, the present invention is directed to a downhole perforator assembly comprising a downhole power unit, an actuator and a downhole perforator. The downhole power unit includes a power unit housing and a moveable shaft. The actuator includes an actuator housing, an actuator mandrel slidably positioned within the actuator housing and a piston slidably positioned within the actuator housing. The downhole perforator includes a perforator housing, a perforator mandrel slidably positioned within the perforator housing and a penetrator radially outwardly extendable from the perforator housing.

In operation, the power unit housing is operably associated with the actuator housing and the moveable shaft is operably associated with the actuator mandrel. In addition, the actuator housing is operably associated with the perforator housing and the piston is operably associated with the perforator mandrel. In this configuration, when the downhole power unit is activated and the moveable shaft is longitudinally shifted relative to the power unit housing, the piston longitudinally shifts relative to the actuator housing and actuator mandrel, thereby longitudinally shifting the perforator mandrel relative to the perforator housing causing at least a portion of the penetrator is extended radially outwardly from the perforator housing.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1C:
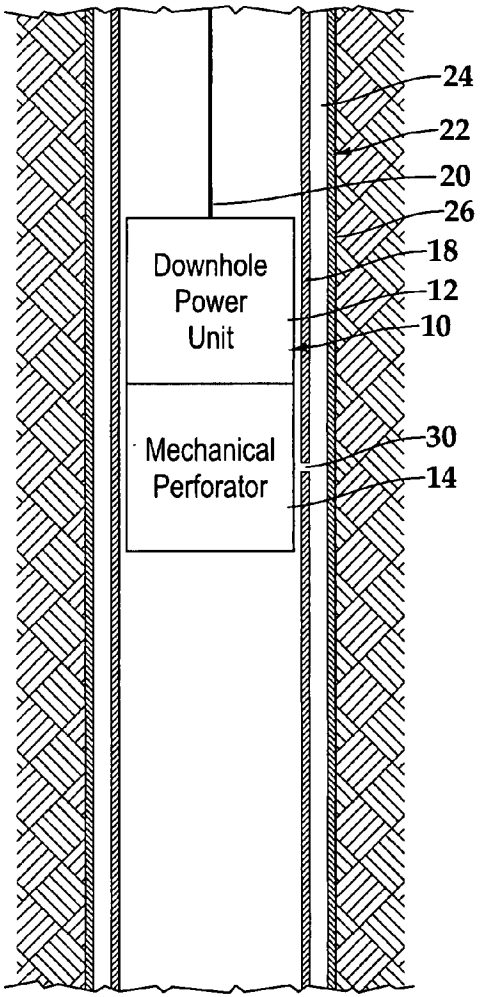
FIGS. 1A-1C are block diagrams illustrating the operation of a downhole perforator assembly according to the present invention.
Figure 1B:
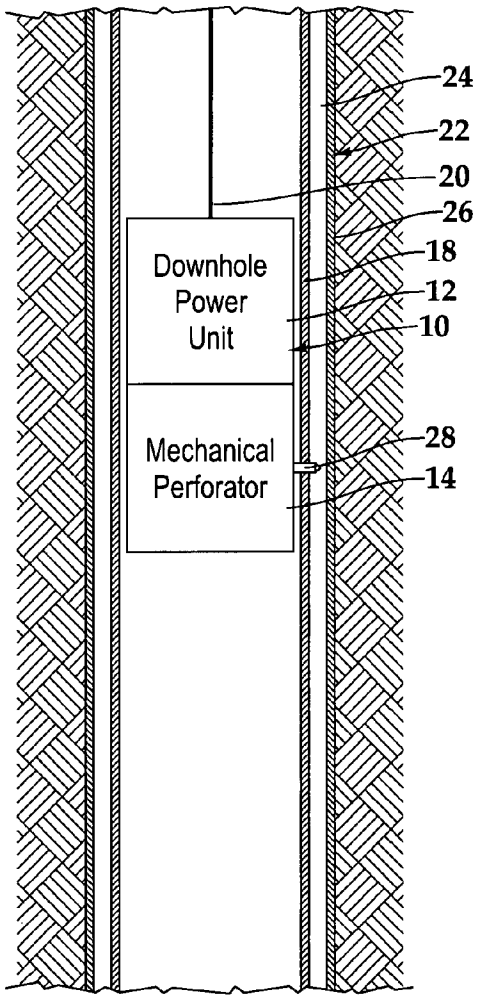
Figure 1A:
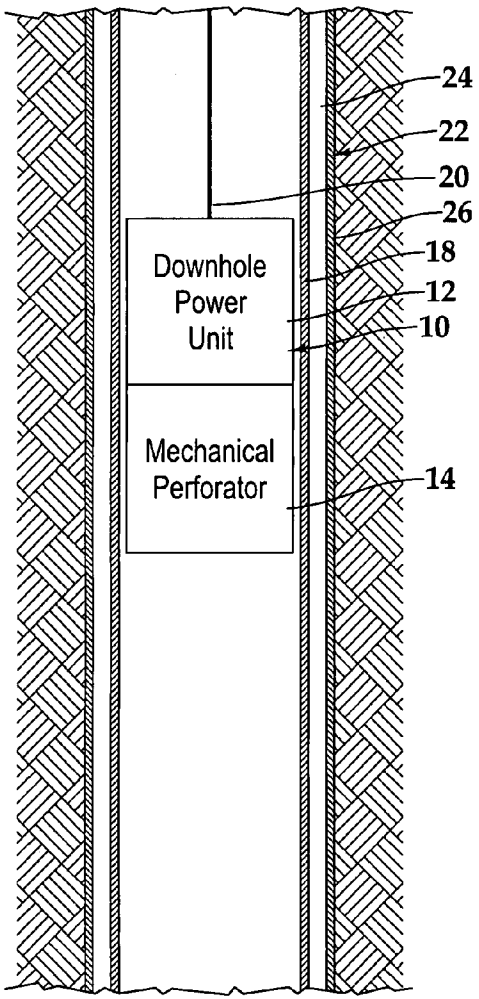

Referring initially to FIGS. 1A-1C, therein is schematically depicted a downhole perforator assembly of the present invention in its various operational states that is generally designated 10. Downhole perforator assembly 10 includes a downhole power unit 12 and a downhole mechanical perforator 14, each of which will be discussed in greater detail below. Downhole perforator assembly 10 has a moveable member described herein as a moveable shaft that is operably associated with and couples to downhole perforator 14. Downhole perforator assembly 10 is illustrated as having been lowered into a tubular string 18 such as a casing string, a liner string, a tubing string or the like on a conveyance 20 such as a wireline, a slickline, coiled tubing, jointed tubing, downhole robot or the like.

In the illustrated embodiment, tubular string 18 has been previously installed within well 22 such that an annulus 24 is formed between casing 26 and tubular string 18. Tubular string 18 has, for example, previously been used to produce fluids from a subterranean hydrocarbon bearing reservoir (not shown) that is intersected by well 22. Due to a flow rate decreased or other lack of productivity, however, it has been determined that a workover should be performed on well 22 including pulling tubular string 18. As described above, to control well 22 during the workover, a workover fluid must be circulated in to well 22. In order to allow such circulation, however, a communication path must be established between the interior of tubular string 18 and annulus 24.

As depicted in FIG. 1A, downhole perforator assembly 10 has reached its target location in well 22. As explained in greater detail below, downhole perforator 14 is operated from its running configuration to its perforating configuration using downhole power unit 12. Specifically, downhole power unit 12 transmits a longitudinal force to a mandrel within downhole perforator 14 via a moveable shaft of downhole power unit 12 such that a penetrator 28 is radially outwardly projected from downhole perforator 14. As best seen in FIG. 1B, penetrator 28 extends radially outwardly from downhole perforator 14 and through the sidewall of tubular string 18. Further longitudinal movement of the mandrel of downhole perforator 14 causes penetrator 28 to retract within downhole perforator 14. As best seen in FIG. 1C, once penetrator 28 has been retracted, a fluid passageway 30 is formed through tubular string 18, thereby allowing the circulation of fluids between the interior of tubular string 18 and annulus 24. After fluid passageway 30 has been formed, downhole perforator assembly 10 can be retrieved to the surface.

As will be described in more detail below, a particular implementation of downhole power unit 12 includes an elongated housing, a motor disposed in the housing and a sleeve connected to a rotor of the motor. The sleeve is a rotational member that rotates with the rotor. A moveable member such as the above-mentioned moveable shaft is received within the threaded interior of the sleeve. Operation of the motor rotates the sleeve which causes the moveable shaft to move longitudinally. Accordingly, when downhole power unit 12 is operably coupled with downhole perforator 14 and the moveable member is activated, longitudinal movement is imparted to the mandrel of downhole perforator 14.

Preferably, a microcontroller made of suitable electrical components to provide miniaturization and durability within the high pressure, high temperature environments which can be encountered in an oil or gas well is used to control the operation of downhole power unit 12. The microcontroller is preferably housed within the structure of downhole power unit 12, it can, however, be connected outside of downhole power unit 12 but within an assoicated tool string moved into well 22. In whatever physical location the microcontroller is disposed, it is operationally connected to downhole power unit 12 to control movement of the moveable member when desired. In one embodiment, the microcontroller includes a microprocessor which operates under control of a timing device and a program stored in a memory. The program in the memory includes instructions which cause the microprocessor to control the downhole power unit 12.

The microcontroller operates under power from a power supply which can be at the surface of well 22 or, preferably, contained within the microcontroller, downhole power unit 12 or otherwise within a downhole portion of the tool string of which these components are a part. For a particular implementation, the power source provides the electrical power to both the motor of downhole power unit 12 and the microcontroller. When downhole power unit 12 is at the target location, the microcontroller commences operation of downhole power unit 12 as programmed. For example, with regard to controlling the motor that operates the sleeve receiving the moveable member, the microcontroller sends a command to energize the motor to rotate the sleeve in the desired direction to either extend or retract the moveable member at the desired speed. One or more sensors monitor the operation of downhole power unit 12 and provide responsive signals to the microcontroller. When the microcontroller determines that a desired result has been obtained, it stops operation of downhole power unit 12, such as by de-energizing the motor.

Even though FIGS. 1A-1C depict a vertical well, it should be noted by one skilled in the art that the downhole perforator assembly of the present invention is equally well-suited for use in deviated wells, inclined wells or horizontal wells. As such, the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure.

Figure 2C:
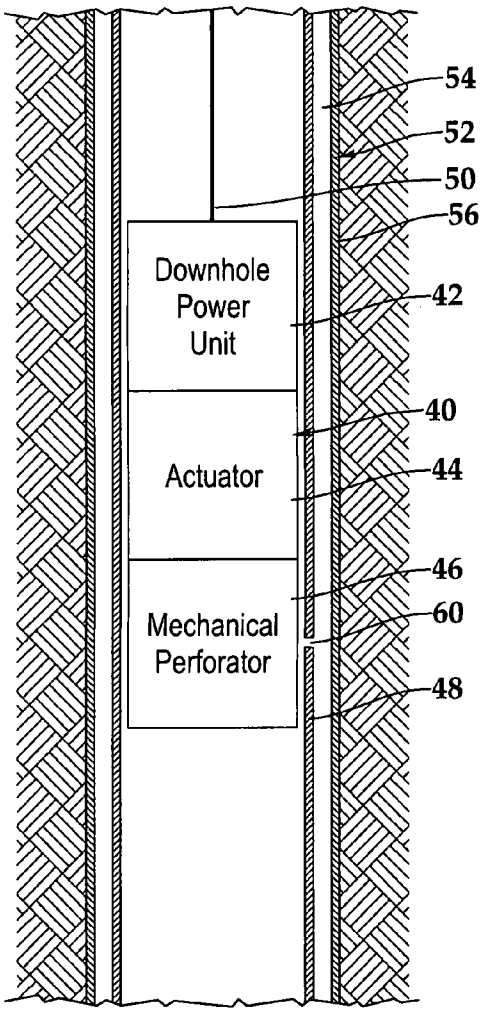
FIGS. 2A-2C are block diagrams illustrating the operation of another downhole perforator assembly according to the present invention.
Figure 2B:
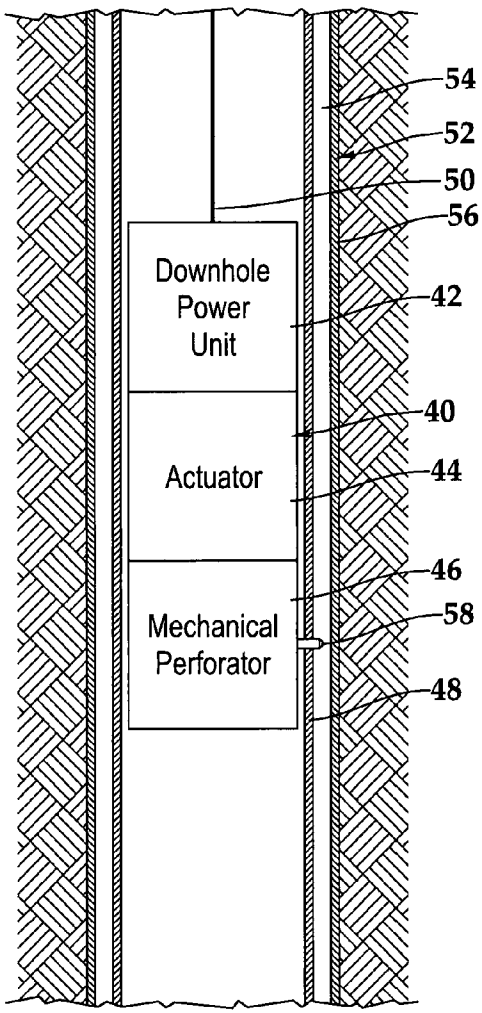
Figure 2A:
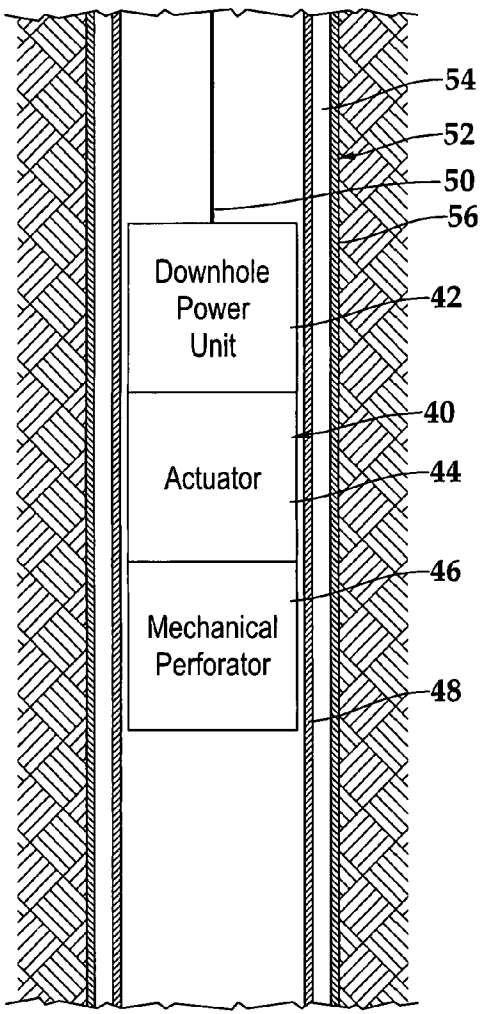

Referring next to FIGS. 2A-2C, therein is schematically depicted a downhole perforator assembly of the present invention in its various operational states that is generally designated 40. Downhole perforator assembly 40 includes a downhole power unit 42, an actuator 44 and a downhole mechanical perforator 46, each of which will be discussed in greater detail below. Downhole perforator assembly 40 has a moveable shaft that is operably associated with and coupled to actuator 44. Actuator 44 has a piston that is operably associated with and coupled to downhole perforator 14. Downhole perforator assembly 40 is illustrated as having been lowered into a tubular string 48 on a conveyance 50 such as a wireline, a slickline, coiled tubing, jointed pipe or other tubing string.

In the illustrated embodiment, tubular string 48 has been previously installed within well 52 such that an annulus 54 is formed between casing 56 and tubular string 48. As in the example above, tubular string 48 has previously been used to produce fluids from a subterranean hydrocarbon bearing reservoir (not shown) that is intersected by well 52 but it has been determined that a workover should be performed on well 52 including pulling tubular string 48. In order to allow circulation of the workover fluid, a communication path must be established between the interior of tubular string 48 and annulus 54.

As depicted in FIG. 2A, downhole perforator assembly 40 has reached its target location in well 52. As explained in greater detail below, downhole perforator 46 is operated from its running configuration to its perforating configuration using downhole power unit 42 and actuator 44. Specifically, downhole power unit 42 transmits a longitudinal force via a moveable shaft to a mandrel within actuator 44 that triggers the operation of a piston within actuator 44. The piston transmits a longitudinal force to a mandrel of downhole perforator 46 such that a penetrator 58 is radially outwardly projected from downhole perforator 46. As best seen in FIG. 1B, penetrator 58 extends radially outwardly from downhole perforator 46 and through the sidewall of tubular string 48. Further longitudinal movement of the mandrel of downhole perforator 46 causes penetrator 58 to retract within downhole perforator 46. As best seen in FIG. 1C, once penetrator 58 has been retracted, a fluid passageway 60 is formed through tubular string 48, thereby allowing the circulation of fluids between the interior of tubular string 48 and annulus 54. After fluid passageway 60 has been formed, downhole perforator assembly 40 can be retrieved to the surface.

Figure 3A:
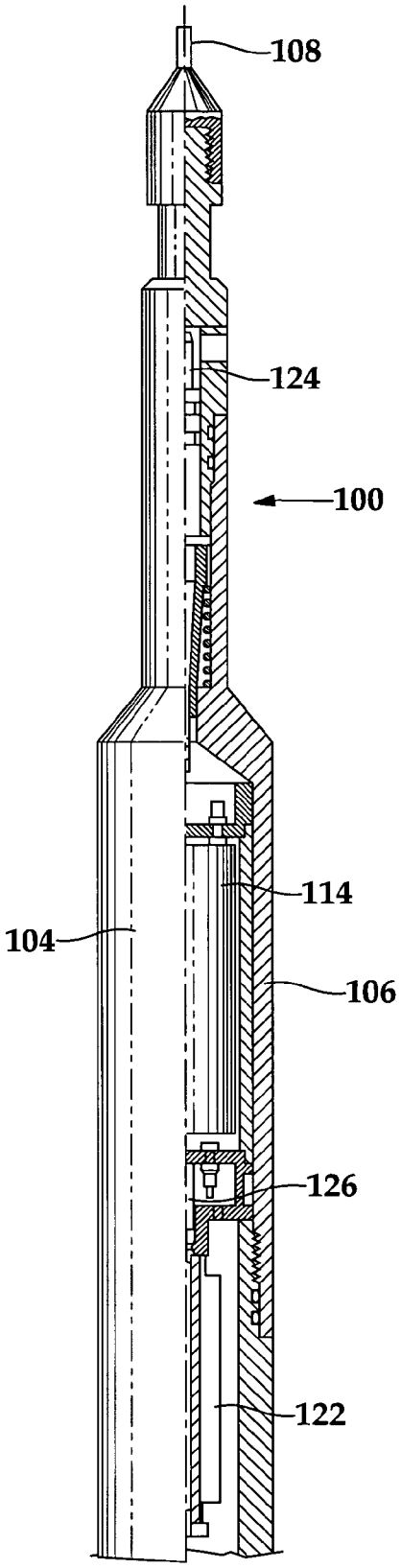
FIGS. 3A-3B are quarter sectional views of successive axial sections of one embodiment of a downhole power unit of a downhole perforator assembly according to the present invention.
Figure 3B:
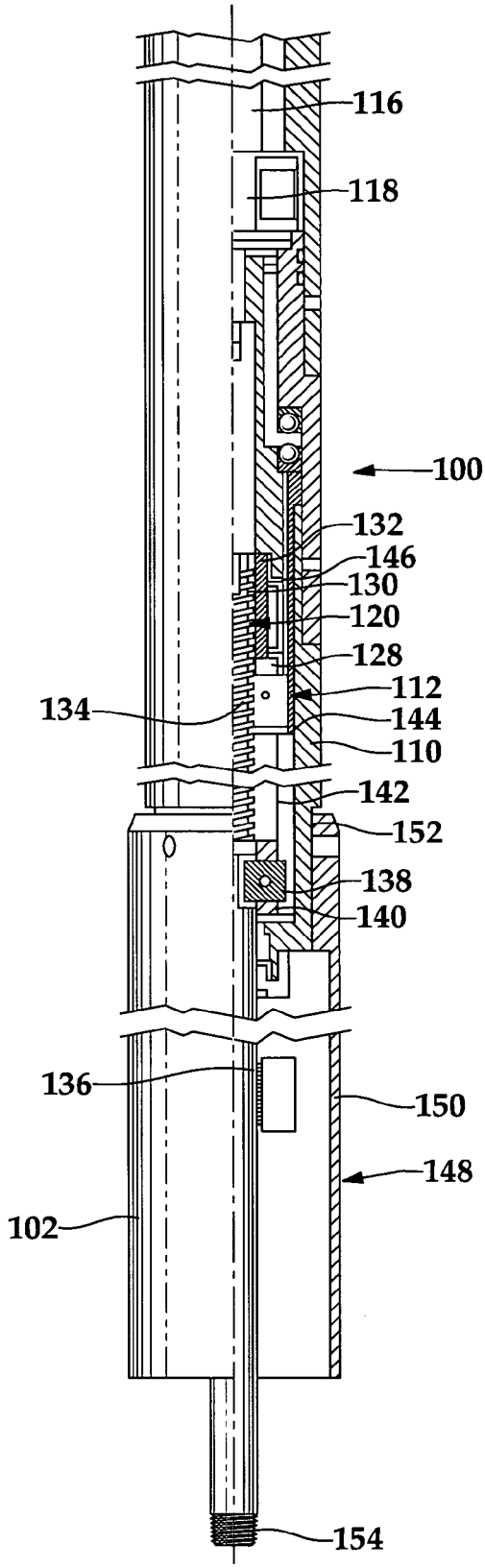

Referring now to FIGS. 3A-3B, therein are depicted successive axial sections of an exemplary downhole power unit that is generally designated 100 and that is capable of operations in the downhole perforator assembly of the present invention. Downhole power unit 100 includes a working assembly 102 and a power assembly 104. Power assembly 104 includes a housing assembly 106 which comprises suitably shaped and connected generally tubular housing members. An upper portion of housing assembly 106 includes an appropriate mechanism to facilitate coupling of housing 106 to a conveyance 108 such as a wireline, slickline, electric line, coiled tubing, jointed tubing or the like. Housing assembly 106 also includes a clutch housing 110 as will be described in more detail below, which forms a portion of a clutch assembly 112.

In the illustrated embodiment, power assembly 104 includes a self-contained power source, eliminating the need for power to be supplied from an exterior source, such as a source at the surface. A preferred power source comprises a battery assembly 114 which may include a plurality of batteries such as alkaline batteries, lithium batteries or the like.

Connected with power assembly 104 is the force generating and transmitting assembly. The force generating and transmitting assembly of this implementation includes a direct current (DC) electric motor 116, coupled through a gearbox 118, to a jackscrew assembly 120. A plurality of activation mechanisms 122, 124 and 126, as will be described, can be electrically coupled between battery assembly 114 and electric motor 116. Electric motor 116 may be of any suitable type. One example is a motor operating at 7500 revolutions per minute (rpm) in unloaded condition, and operating at approximately 5000 rpm in a loaded condition, and having a horsepower rating of approximately 1/30th of a horsepower. In this implementation, motor 116 is coupled through the gearbox 118 which provides approximately 5000:1 gear reduction. Gearbox 118 is coupled through a conventional drive assembly 128 to jackscrew assembly 120.

The jackscrew assembly 120 includes a threaded shaft 130 which moves longitudinally, rotates or both, in response to rotation of a sleeve assembly 132. Threaded shaft 130 includes a threaded portion 134, and a generally smooth, polished lower extension 136. Threaded shaft 130 further includes a pair of generally diametrically opposed keys 138 that cooperate with a clutch block 140 which is coupled to threaded shaft 130. Clutch housing 110 includes a pair of diametrically opposed keyways 142 which extend along at least a portion of the possible length of travel. Keys 138 extend radially outwardly from threaded shaft 130 through clutch block 140 to engage each of keyways 142 in clutch housing 110, thereby selectively preventing rotation of threaded shaft 130 relative to housing 110.

Rotation of sleeve assembly 132 in one direction causes threaded shaft 130 and clutch block 140 to move longitudinally upwardly relative to housing assembly 110 if shaft 130 is not at its uppermost limit. Rotation of the sleeve assembly 132 in the opposite direction moves shaft 130 downwardly relative to housing 110 if shaft 130 is not at its lowermost position. Above a certain level within clutch housing 110, as indicated generally at 144, clutch housing 110 includes a relatively enlarged internal diameter bore 146 such that moving clutch block 140 above level 144 removes the outwardly extending key 138 from being restricted from rotational movement. Accordingly, continuing rotation of sleeve assembly 132 causes longitudinal movement of threaded shaft 130 until clutch block 140 rises above level 144, at which point rotation of sleeve assembly 132 will result in free rotation of threaded shaft 130. By virtue of this, clutch assembly 112 serves as a safety device to prevent burn-out of the electric motor, and also serves as a stroke limiter. In a similar manner, clutch assembly 112 may allow threaded shaft 130 to rotation freely during certain points in the longitudinal travel of threaded shaft 130.

In the illustrated embodiment, downhole power unit 100 incorporates three discrete activation assemblies, separate from or part of the microcontroller discussed above. The activation assemblies enable jackscrew 120 to operate upon the occurrence of one or more predetermined conditions. One depicted activation assembly is timing circuitry 122 of a type known in the art. Timing circuitry 122 is adapted to provide a signal to the microcontroller after passage of a predetermined amount of time. Further, downhole power unit 100 can include an activation assembly including a pressure-sensitive switch 124 of a type generally known in the art which will provide a control signal, for example, once the switch 124 reaches a depth at which it encounters a predetermined amount of hydrostatic pressure within the tubing string or experiences a particular pressure variation or series of pressure variations. Still further, downhole power unit 100 can include a motion sensor 126, such as an accelerometer or a geophone, that is sensitive to vertical motion of downhole power unit 100. Accelerometer 126 can be combined with timing circuitry 122 such that when motion is detected by accelerometer 126, timing circuitry 122 is reset. If so configured, the activation assembly operates to provide a control signal after accelerometer 126 detects that downhole power unit 100 has remained substantially motionless within the well for a predetermined amount of time.

Working assembly 102 includes an actuation assembly 148 which is coupled through housing assembly 106 to be movable therewith. Actuation assembly 148 includes an outer sleeve member 150 which is threadably coupled at 152 to housing assembly 106. Threaded shaft 130 extends through actuation assembly 148 and has a threaded end 154 for coupling to other tools such as an actuator or a downhole perforator as will be described below.

In operation, downhole power unit 100 is adapted to cooperate directly with a downhole perforator or indirectly with a downhole perforator via an actuator depending upon the particular implementation the downhole perforator assembly of the present invention. Specifically, prior to run in, outer sleeve member 150 of downhole power unit 100 is operably associated with a mating tubular of a downhole perforator or an actuator as described below. Likewise, shaft 130 of downhole power unit 100 is operably associated with a mating mandrel of a downhole perforator or an actuator as described below. As used herein, the term operably associated with shall encompass direct coupling such as via a threaded connection, a pinned connection, a frictional connection, a closely received relationship and may also including the use of set screws or other securing means. In addition, the term operably associated with shall encompass indirect coupling such as via a connection sub, an adaptor or other coupling means. As such, an upward longitudinal movement of threaded shaft 130 of downhole power unit 100 exerts an upward longitudinal force upon the mandrel to which it is operably associated that initiates the operation of either the downhole perforator or the actuator that is associated therewith as described below.

As will be appreciated from the above discussion, actuation of motor 116 by activation assemblies 122, 124, 126, and control of motor 116 by the microcontroller results in the required longitudinal movement of threaded shaft 130. In the implementation wherein the downhole perforator assembly includes an actuator, threaded shaft 130 is only required to move a short distance to exert sufficient force to break certain shear pins then the pressure differential created within the actuator is used to operate the downhole perforator. In the implementation wherein the downhole perforator assembly does not includes an actuator, threaded shaft 130 is required to move a short distance to exert sufficient force to break certain shear pins then continues its upward movement for a longer stroke to directly operate the downhole perforator to both radially extend and radially retract the penetrator of the downhole perforator. In either case, downhole power unit 100 may be preprogrammed to perform the proper operations prior to deployment into the well. Alternatively, downhole power unit 100 may receive power, command signals or both from the surface via an umbilical cord. Once the perforating operation is complete, the downhole perforator assembly of the present invention may be retrieved to the surface.

Even though a particular embodiment of a downhole power unit has been depicted and described, it should be clearly understood by those skilled in the art that other types of downhole power devices could alternatively be used with the downhole perforator assembly of the present invention such that the downhole perforator assembly of the present invention may establish communication between the interior of a downhole tubular and the surrounding annulus.

Figure 4:
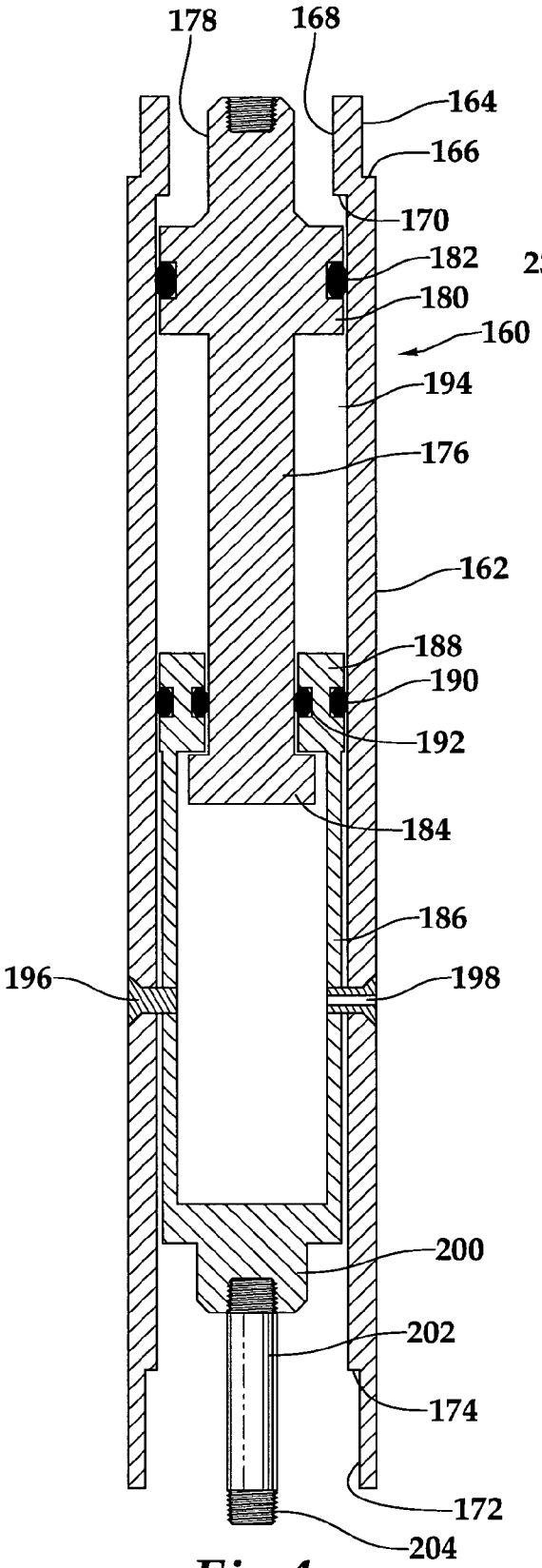
FIG. 4 is a cross sectional view of one embodiment of an actuator of a downhole perforator assembly according to the present invention.

Referring now to FIG. 4, therein is depicted an exemplary actuator that is generally designated 160 and that is capable of operations in the downhole perforator assembly of the present invention. Actuator 160 includes an outer housing 162. At its upper end, outer housing 162 has a radially reduced exterior portion 164 and an exterior shoulder 166 that allow for coupling with outer sleeve member 150 of downhole power unit 100. This coupling may be achieved using a threaded connection, a pin connection or other suitable means. Outer housing 162 also has a radially reduced interior portion 168 and an internal shoulder 170. In addition, outer housing 162 has a radially expanded interior portion 172 and an interior shoulder 174 at it lower end.

Slidably and sealing disposed within outer housing 162 is a mandrel 176. Mandrel 176 includes an upper connector 178 that is designed to threadably couple to shaft 130 of downhole power unit 100. Mandrel 176 has a radially expanded section 180 including a seal groove having a seal 182 located therein, which provides the sealing relationship with the interior of outer housing 162. Mandrel 176 also has a radially expanded lower section 184.

Actuator 160 further includes a piston 186 that is slidably and sealing disposed within outer housing 162. Piston 186 has a radially reduced upper portion 188 that is positioned above radially expanded lower section 184 of mandrel 176. Radially reduced upper portion 188 includes an exterior seal groove having a seal 190 located therein, which provides a sealing relationship with the interior of outer housing 162. Radially reduced upper portion 188 also includes an interior seal groove having a seal 192 located therein, which provides a sealing relationship with the exterior of mandrel 176. When assembled in this manner, an atmospheric chamber 194 is created within actuator 160 between seals 182, 190, 192. Piston 186 is initially fixed relative to outer housing 162 by a plurality of shear pins 196 at least one of which may include a fluid passageway 198 to allow communication of annular fluid pressure into the interior of actuator 160 below seals 190, 192, thus establishing a pressure differential thereacross. The fluid passageway may include a choke or other flow control device to meter the rate at which annular fluid may enter the interior of actuator 160. Piston 186 includes a lower connector 200 that is designed to threadably couple to shaft 202. Shaft 202 has a lower threaded end 204.

In operation, an upward force is placed on mandrel 176 by downhole power unit 100 via shaft 130 moving radially expanded section 180 into contact with shoulder 170 which breaks shear pins 196 and releases piston 186 from its initial fixed relationship with outer housing 162. Once piston 186 is free to move relative to outer housing 162, the differential pressure acting on seals 190 causes piston 186 to move upwardly relative to outer housing 162 and mandrel 176. This upward movement of piston 186 upwardly shifts shaft 202. As such, use of the downhole power unit 100 in combination with actuator 160 provides for higher velocity in the longitudinal movement transferred to the downhole perforator than through use of the downhole power unit 100 alone. Accordingly, when it is desirable to create high velocity longitudinal movement to accomplish a tubular penetration, actuator 160 may be included with the downhole perforator assembly of the present invention.

Even though a particular embodiment of an actuator has been depicted and described, it should be clearly understood by those skilled in the art that other types of actuators could alternatively be used in the downhole perforator assembly of the present invention.

Figure 5:
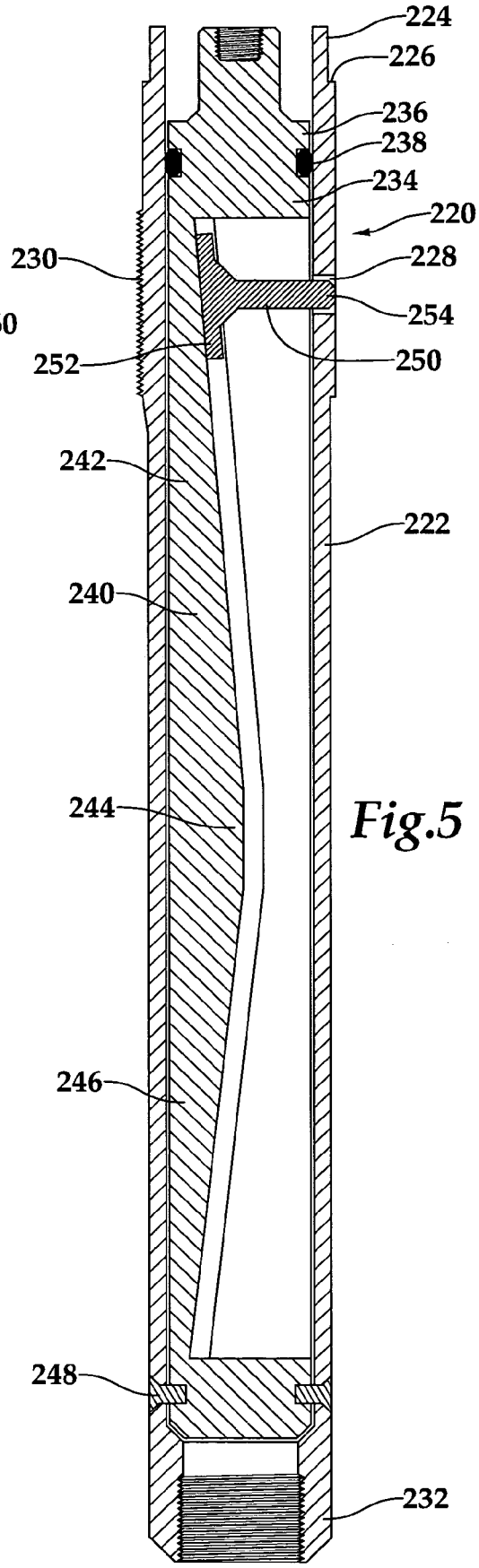
FIG. 5 is a cross sectional view of one embodiment of a downhole perforator of a downhole perforator assembly according to the present invention.

Referring now to FIG. 5, therein is depicted a first embodiment of a downhole perforator that is generally designated 220 and that is capable of operations in the downhole perforator assembly of the present invention. Downhole perforator 220 includes an outer housing 222. At its upper end, outer housing 222 has a radially reduced exterior portion 224 and an exterior shoulder 226 that allow for coupling with outer sleeve member 150 of downhole power unit 100 or coupling with outer housing 162 of actuator 160 depending upon the particular implementation of the downhole perforator assembly of the present invention. In either case, the coupling may be achieved using a threaded connection, a pin connection or other suitable means. Outer housing 222 includes a penetrator opening 228. Disposed opposite penetrator opening 228 on the exterior of outer housing 222 is a slip member 230 that prevents movement of downhole perforator 220 relative to the tubular string receiving downhole perforator 220 during the perforation operation. Outer housing 222 has a lower connector 232 that allows downhole perforator 220 to be threadably coupled to other downhole tools or may receive a threaded plug therein.

Slidably and sealing disposed within outer housing 222 is a mandrel 234. Mandrel 234 includes an upper connector 236 that is designed to threadably couple to shaft 130 of downhole power unit 100 or shaft 202 of actuator 160. Mandrel 234 has a radially expanded section 236 including a seal groove having a seal 238 located therein, which provides the sealing relationship with the interior outer housing 222. Mandrel 234 has a slotted ramp member 240 having an increasing slope section 242, a flat section 244 and a decreasing slope section 246. Mandrel 234 is initially fixed relative to outer housing 222 via shear pins 248.

Downhole perforator 220 also includes a penetrator 250 that is disposed between mandrel 234 and outer housing 222. Penetrator 250 has a base section 252 that is received within slotted ramp member 240 of mandrel 234 and slides along slotted ramp member 240 when mandrel 234 is shifted longitudinally upwardly relative to outer housing 222. Penetrator 250 also has a punch member 254 that is received within penetrator opening 228 of outer housing 222.

In operation, an upward force is placed on mandrel 234 directly by downhole power unit 100 via shaft 130 or by actuator 160 via piston 186 which breaks shear pins 248 releasing mandrel 234 from its initial fixed relationship with outer housing 222. As mandrel 234 is shifted longitudinally upwardly relative to outer housing 222, punch member 254 is radially outwardly extended from outer housing 222 as base section 252 slides along increasing slope section 242 of mandrel 234. Once flat section 244 is behind base section 252, punch member 254 is in its fully radially extended position. Continued upward shifting of mandrel 234 relative to outer housing 222 will then retract punch member 254 back into outer housing 222 as base section 252 slides down decreasing slope section 246. In this manner, downhole perforator 220 is able to create an opening through the sidewall of the tubular in which downhole perforator 220 is located.

Figure 6:
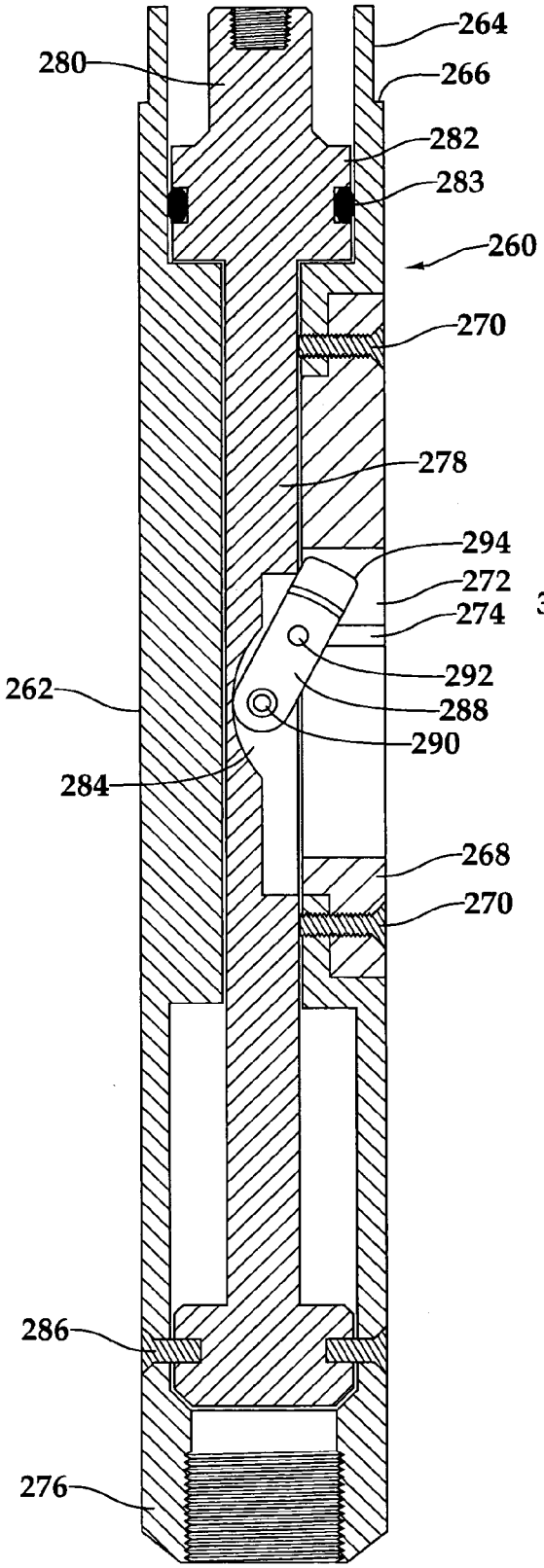
FIG. 6 is a cross sectional view of a second embodiment of a downhole perforator of a downhole perforator assembly according to the present invention.

Referring now to FIG. 6, therein is depicted a second embodiment of a downhole perforator that is generally designated 260 and that is capable of operations in the downhole perforator assembly of the present invention. Downhole perforator 260 includes an outer housing 262. At its upper end, outer housing 262 has a radially reduced exterior portion 264 and an exterior shoulder 266 that allow for coupling with outer sleeve member 150 of downhole power unit 100 or coupling with outer housing 162 of actuator 160 depending upon the particular implementation of the downhole perforator assembly of the present invention. In either case, the coupling may be achieved using a threaded connection, a pin connection or other suitable means. Outer housing 262 includes a penetrator guide member 268 that is attached to outer housing 262 via screws 270. Penetrator guide member 268 includes a longitudinal slot 272 and a radial slot 274. Outer housing 262 has a lower connector 276 that allows downhole perforator 260 to be threadably coupled to other downhole tools or may receive a threaded plug therein.

Slidably and sealing disposed within outer housing 262 is a mandrel 278. Mandrel 278 includes an upper connector 280 that is designed to threadably couple to shaft 130 of downhole power unit 100 or shaft 202 of actuator 160. Mandrel 278 has a radially expanded section 282 including a seal groove having a seal 283 located therein, which provides the sealing relationship with the interior outer housing 262. Mandrel 278 has a longitudinal slot 284. Mandrel 278 is initially fixed relative to outer housing 262 via shear pins 286.

Downhole perforator 260 also includes a penetrator 288 that is disposed within longitudinal slot 284 of mandrel 278 and longitudinal slot 272 of other housing 262. Penetrator 288 is rotatably mounted to mandrel 278 via a pin 290. Penetrator 288 also has an alignment pin 292 that is positioned within radial slot 274 of outer housing 262.

In operation, an upward force is placed on mandrel 278 directly by downhole power unit 100 via shaft 130 or by actuator 160 via piston 186 which breaks shear pins 286 releasing mandrel 276 from its initial fixed relationship with outer housing 262. As mandrel 278 is shifted longitudinally upwardly relative to outer housing 262, penetrator 288 rotates within longitudinal slot 284 of mandrel 278 and longitudinal slot 272 of other housing 262 about pin 290 and alignment pin 292 moves radially outwardly in radial slot 274 of outer housing 262. As penetrator 288 rotates, a cutting surface 294 of penetrator 288 extends radially outwardly from outer housing 262. Continued upward shifting of mandrel 278 relative to outer housing 262 continues to rotate penetrator 288 until it is retracted into outer housing 262. In this manner, downhole perforator 260 is able to create a longitudinal cut through the sidewall of the tubular in which downhole perforator 260 is located.

Figure 7:
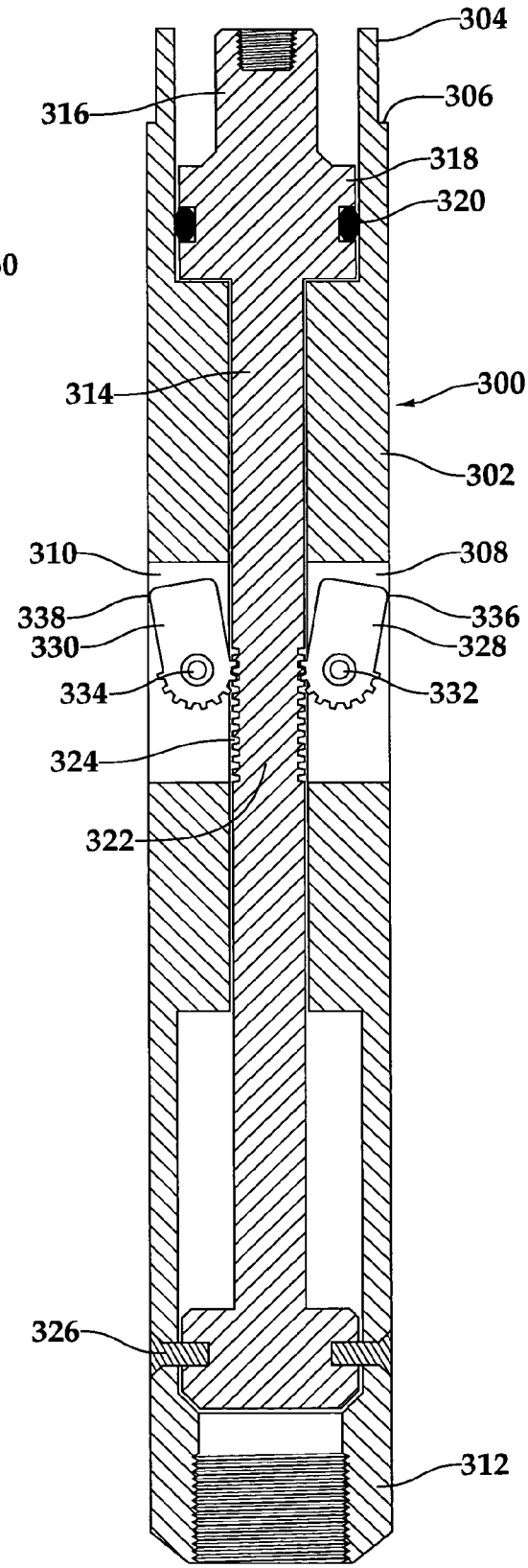
FIG. 7 is a cross sectional view of a third embodiment of a downhole perforator of a downhole perforator assembly according to the present invention.

Referring now to FIG. 7, therein is depicted a third embodiment of a downhole perforator that is generally designated 300 and that is capable of operations in the downhole perforator assembly of the present invention. Downhole perforator 300 includes an outer housing 302. At its upper end, outer housing 302 has a radially reduced exterior portion 304 and an exterior shoulder 306 that allow for coupling with outer sleeve member 150 of downhole power unit 100 or coupling with outer housing 162 of actuator 160 depending upon the particular implementation of the downhole perforator assembly of the present invention. In either case, the coupling may be achieved using a threaded connection, a pin connection or other suitable means. Outer housing 302 includes a pair of longitudinal slots 308, 310. Outer housing 302 has a lower connector 312 that allows downhole perforator 300 to be threadably coupled to other downhole tools or may receive a threaded plug therein.

Slidably and sealing disposed within outer housing 302 is a mandrel 314. Mandrel 314 includes an upper connector 316 that is designed to threadably couple to shaft 130 of downhole power unit 100 or shaft 202 of actuator 160. Mandrel 314 has a radially expanded section 318 including a seal groove having a seal 320 located therein, which provides the sealing relationship with the interior of outer housing 302. Mandrel 314 has a rack section 322 that has a plurality of teeth 324. Mandrel 314 is initially fixed relative to outer housing 302 via shear pins 326.

Downhole perforator 260 also includes a pair of oppositely disposed penetrators 328, 330 that are respectively positioned within longitudinal slots 308, 310 of other housing 302. Penetrators 328, 330 are rotatably mounted to outer housing 302 via respective pins 332, 334. Each penetrator 328, 330 includes a plurality of teeth that mesh with teeth 324 of mandrel 314.

In operation, an upward force is placed on mandrel 314 directly by downhole power unit 100 via shaft 130 or by actuator 160 via piston 186 which breaks shear pins 326 releasing mandrel 314 from its initial fixed relationship with outer housing 302. As mandrel 314 is shifted longitudinally upwardly relative to outer housing 302, the teeth of penetrators 328, 330 mesh with teeth 324 of mandrel 314 such that penetrators 328, 330 rotate within longitudinal slots 308, 310 of other housing 302 about pins 332, 334. As penetrators 328, 330 rotate, cutting surfaces 336, 338 of penetrators 328, 330 extend radially outwardly from outer housing 302. Continued upward shifting of mandrel 314 relative to outer housing 302 continues to rotate penetrators 328, 330 until they are retracted into outer housing 302. In this manner, downhole perforator 300 is able to create a pair of longitudinal cuts through the sidewall of the tubular in which downhole perforator 300 is located.

Figure 8:
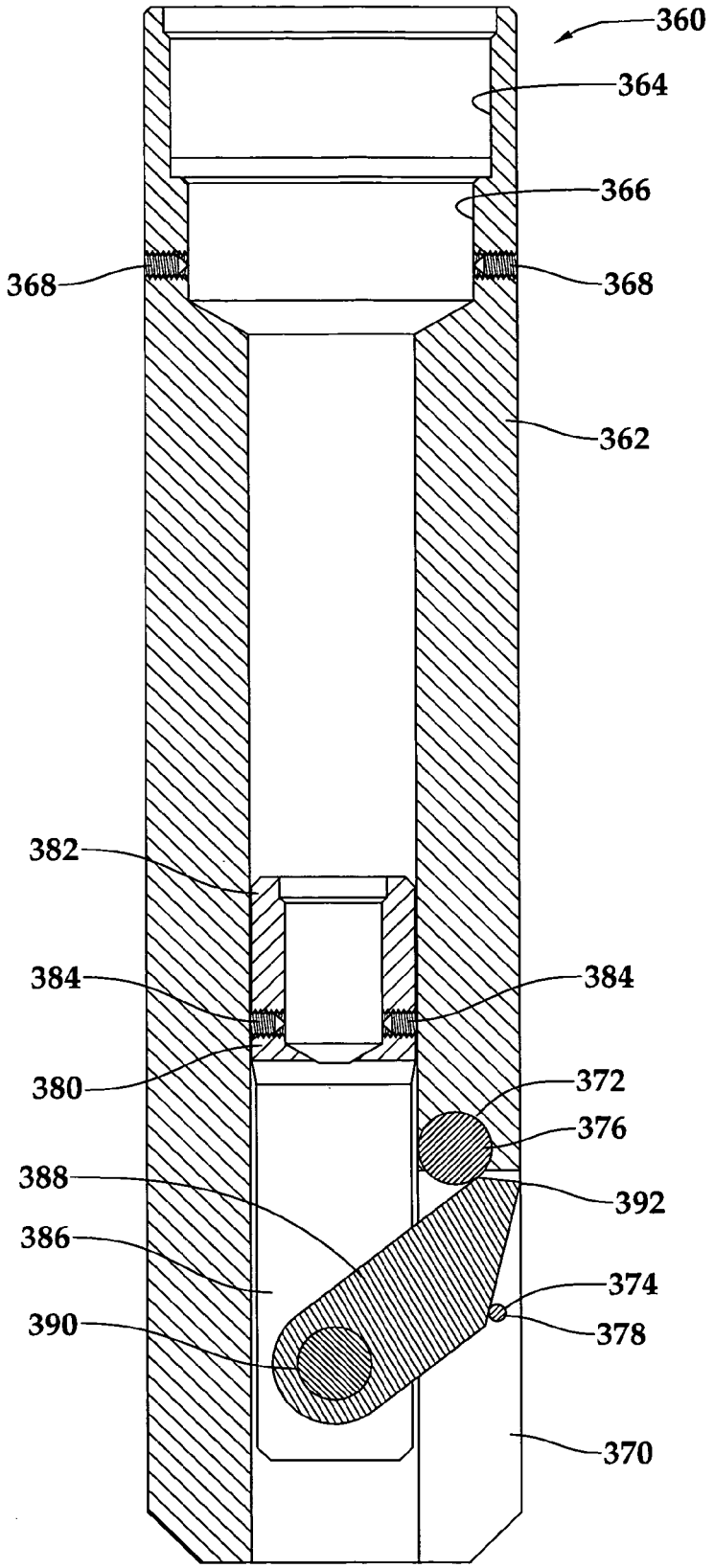
FIG. 8 is a cross sectional view of a fourth embodiment of a downhole perforator of a downhole perforator assembly according to the present invention.

Referring now to FIG. 8, therein is depicted a fourth embodiment of a downhole perforator that is generally designated 360 and that is capable of operations in the downhole perforator assembly of the present invention. Downhole perforator 360 includes an outer housing 362. At its upper end, outer housing 362 has an interior profile 364 including a radially reduced section 366 that allow for coupling with outer sleeve member 150 of downhole power unit 100 via a direct connection with a suitably designed outer sleeve member or via a suitably designed adaptor. Likewise, interior profile 364 allows for coupling with outer housing 162 of actuator 160 via a direct connection with a suitably designed outer housing or via a suitably designed adaptor. In the illustrated embodiment, such coupling is achieved by sliding the mating portion of the downhole power unit 100, actuator 160 or suitable adaptor into profile 364 the tightening set screws 368 to prevent decoupling. Outer housing 362 includes a longitudinal slot 370, a support pin receiving slot 372 and a lock pin receiving slot 374. A support pin 376 is disposed within support pin receiving slot 372 and a lock pin 378 is disposed within lock pin receiving slot 374.

Slidably disposed within outer housing 362 is a mandrel 380. Mandrel 380 includes an upper connector 382 that is designed to receive shaft 130 of downhole power unit 100 or shaft 202 of actuator 160 therein. In the illustrated embodiment, set screws 384 are used to secure the received shaft within upper connector 382. Mandrel 380 has a longitudinal slot 386.

Downhole perforator 360 also includes a penetrator 388 that is disposed within longitudinal slot 386 of mandrel 380 and longitudinal slot 370 of other housing 362. Penetrator 388 is rotatably mounted to mandrel 380 via a pin 390. Longitudinal movement of mandrel 380 relative to housing 362 is initially prevent by lock pin 378 which initially prevents rotation of penetrator 388.

In operation, an upward force is placed on mandrel 380 directly by downhole power unit 100 via shaft 130 or by actuator 160 via piston 186 which breaks lock pin 378 releasing mandrel 380 from its initial fixed relationship with outer housing 362. As mandrel 380 is shifted longitudinally upwardly relative to outer housing 362, penetrator 388 rotates within longitudinal slot 386 of mandrel 380 and longitudinal slot 370 of other housing 362 about pin 390 and with the aid of pin 376. As penetrator 388 rotates, a cutting surface 392 of penetrator 388 extends radially outwardly from outer housing 362. Continued upward shifting of mandrel 380 relative to outer housing 362 continues to rotate penetrator 388 until it is retracted into outer housing 362. In this manner, downhole perforator 360 is able to create a longitudinal cut through the sidewall of the tubular in which downhole perforator 360 is located.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A downhole perforator assembly for establishing communication between an interior of a tubular disposed within a wellbore having a substantially longitudinal wellbore axis and an annulus around the tubular, the downhole perforator assembly comprising:

a downhole power unit having a power unit housing, a self-contained power source for providing electrical power and a moveable shaft; and a downhole perforator having a perforator housing, a mandrel slidably positioned within the perforator housing and a penetrator radially outwardly extendable from the perforator housing, the power unit housing operably associated with the perforator housing and the moveable shaft operably associated with the mandrel such that when the downhole power unit is activated and the moveable shaft is longitudinally shifted relative to the power unit housing along a shaft axis substantially parallel to the wellbore axis, the mandrel is longitudinally shifted relative to the perforator housing along the shaft axis and at least a portion of the penetrator is extended radially outwardly from the perforator housing.

2. The downhole perforator assembly as recited in claim 1 wherein the downhole power unit further comprises:

an electric motor including a rotor; and a jackscrew assembly including a rotational member connected to the rotor, the rotational member operably associated with the moveable shaft to impart motion thereto.

3. The downhole perforator assembly as recited in claim 1 wherein the downhole power unit further comprises a controller that controls the operation of the moveable shaft.

4. The downhole perforator assembly as recited in claim 1 wherein the penetrator further comprises a radial punch.

5. The downhole perforator assembly as recited in claim 1 wherein the penetrator further comprises a rotatable cutting member.

6. The downhole perforator assembly as recited in claim 1 wherein the penetrator further comprises a pair of oppositely disposed rotatable cutting members.

7. The downhole perforator assembly as recited in claim 1 wherein the mandrel includes a ramp that urges the penetrator radially outwardly relative to the perforator housing when the mandrel is longitudinally shifted relative the perforator housing.

8. The downhole perforator assembly as recited in claim 1 wherein the mandrel is rotatably coupled to the penetrator such that the penetrator rotates and extends radially outwardly relative to the perforator housing when the mandrel is longitudinally shifted relative the perforator housing.

9. The downhole perforator assembly as recited in claim 1 wherein the mandrel includes a rack that mates with teeth of the penetrator and wherein the penetrator is rotatably coupled to the perforator housing such that the penetrator rotates and extends radially outwardly relative to the perforator housing when the mandrel is longitudinally shifted relative the perforator housing.

10. A method for perforating a tubular disposed within a wellbore having a substantially longitudinal wellbore axis, the method comprising the steps of:

providing a downhole power unit having a power unit housing, a self-contained power source for providing electrical power and a moveable shaft;

providing a downhole perforator having a perforator housing, a mandrel and a penetrator;

operably associating the power unit housing with the perforator housing;

operably associating the moveable shaft with the mandrel;

disposing the downhole power unit and downhole perforator in the well;

activating the self-contained power source of the downhole power unit to longitudinally shift the moveable shaft relative to the power unit housing along a shaft axis substantially parallel to the wellbore axis, thereby longitudinally shifting the mandrel relative to the perforator housing along the shaft axis; and responsive to the longitudinal shifting of the mandrel, radially extending at least a portion of the penetrator outwardly from the perforator housing, thereby perforating the tubular.

11. The method as recited in claim 10 wherein the step of activating the downhole power unit further comprises operating timing circuitry to provide a signal to a microcontroller after passage of a predetermined amount of time.

12. The method as recited in claim 10 wherein the step of activating the downhole power unit further comprises operating a pressure-sensitive switch to provide a signal to a microcontroller upon encountering a predetermined amount of pressure.

13. The method as recited in claim 10 wherein the step of activating the downhole power unit further comprises operating a motion sensor to provide a signal to a microcontroller upon encountering a predetermined motion state.

14. The method as recited in claim 10 wherein the step of activating the downhole power unit to longitudinally shift the moveable shaft relative to the power unit housing further comprises operating a jackscrew assembly.

15. The method as recited in claim 10 wherein the step of radial extending at least a portion of the penetrator outwardly from perforator housing further comprises radially outwardly urging the penetrator relative to the perforator housing with a ramp of the mandrel.

16. The method as recited in claim 10 wherein the step of radially extending at least a portion of the penetrator outwardly from perforator housing further comprises rotating the penetrator relative to the mandrel.

17. The method as recited in claim 10 wherein the step of radial extending at least a portion of the penetrator outwardly from perforator housing further comprises rotating the penetrator relative to the perforator housing.

18. The method as recited in claim 10 wherein the step of radial extending at least a portion of the penetrator outwardly from perforator housing further comprises rotating a pair of penetrators relative to the perforator housing.

19. A downhole perforator assembly for establishing communication between an interior of a tubular disposed within a wellbore having a substantially longitudinal wellbore axis and an annulus around the tubular, the downhole perforator assembly comprising:

a downhole power unit having a power unit housing, a self-contained power source for providing electrical power and a moveable shaft;

an actuator having an actuator housing, an actuator mandrel slidably positioned within the actuator housing and a piston slidably positioned within the actuator housing, the power unit housing operably associated with the actuator housing and the moveable shaft operably associated with the actuator mandrel; and a downhole perforator having a perforator housing, a perforator mandrel slidably positioned within the perforator housing and a penetrator radially outwardly extendable from the perforator housing, the actuator housing operably associated with the perforator housing and the piston operably associated with the perforator mandrel such that when the downhole power unit is activated and the moveable shaft is longitudinally shifted relative to the power unit housing along a shaft axis substantially parallel to the wellbore axis, the piston is longitudinally shifted relative to the actuator housing and the actuator mandrel, thereby longitudinally shifting the perforator mandrel relative to the perforator housing along the shaft axis such that at least a portion of the penetrator is extended radially outwardly from the perforator housing.

20. The method as recited in claim 10 wherein the step of radially extending at least a portion of the penetrator outwardly from perforator housing further comprises shifting a rotatable cutting member.

21. The downhole perforator assembly as recited in claim 19 wherein the downhole power unit further comprises:

an electric motor including a rotor; and a jackscrew assembly including a rotational member connected to the rotor, the rotational member operably associated with the moveable shaft to impart motion thereto.

22. The downhole perforator assembly as recited in claim 19 wherein the downhole power unit further comprises a controller that controls the operation of the moveable shaft.

23. The downhole perforator assembly as recited in claim 19 wherein the penetrator further comprises a rotatable cutting member.

24. The downhole perforator assembly as recited in claim 19 wherein the perforator mandrel is rotatably coupled to the penetrator such that the penetrator rotates and extends radially outwardly relative to the perforator housing when the perforator mandrel is longitudinally shifted relative the perforator housing.

25. A downhole perforator assembly for establishing communication between an interior of a tubular disposed within a wellbore having a substantially longitudinal wellbore axis and an annulus around the tubular, the downhole perforator assembly comprising:

a downhole power unit having a power unit housing, a moveable shaft, an electric motor including a rotor and a jackscrew assembly including a rotational member connected to the rotor, the rotational member operably associated with the moveable shaft to impart motion thereto; and a downhole perforator having a perforator housing, a mandrel slidably positioned within the perforator housing and a penetrator radially outwardly extendable from the perforator housing, the power unit housing operably associated with the perforator housing and the moveable shaft operably associated with the mandrel such that when the downhole power unit is activated and the moveable shaft is longitudinally shifted relative to the power unit housing along a shaft axis substantially parallel to the wellbore axis, the mandrel is longitudinally shifted relative to the perforator housing along the shaft axis and at least a portion of the penetrator is extended radially outwardly from the perforator housing.

26. The downhole perforator assembly as recited in claim 25 wherein the downhole power unit further comprises a controller that controls the operation of the moveable shaft.

27. The downhole perforator assembly as recited in claim 25 wherein the penetrator further comprises a radial punch.

28. The downhole perforator assembly as recited in claim 25 wherein the penetrator further comprises a rotatable cutting member.

29. The downhole perforator assembly as recited in claim 25 wherein the penetrator further comprises a pair of oppositely disposed rotatable cutting members.

30. The downhole perforator assembly as recited in claim 25 wherein the mandrel includes a ramp that urges the penetrator radially outwardly relative to the perforator housing when the mandrel is longitudinally shifted relative the perforator housing.

31. The downhole perforator assembly as recited in claim 25 wherein the mandrel is rotatably coupled to the penetrator such that the penetrator rotates and extends radially outwardly relative to the perforator housing when the mandrel is longitudinally shifted relative the perforator housing.

32. A downhole perforator assembly for establishing communication between an interior of a tubular disposed within a wellbore having a substantially longitudinal wellbore axis and an annulus around the tubular, the downhole perforator assembly comprising:

a downhole power unit having a power unit housing and a moveable shaft; and a downhole perforator having a perforator housing, a mandrel slidably positioned within the perforator housing and a rotatable penetrator radially outwardly extendable from the perforator housing, the power unit housing operably associated with the perforator housing and the moveable shaft operably associated with the mandrel such that when the downhole power unit is activated and the moveable shaft is longitudinally shifted relative to the power unit housing along a shaft axis substantially parallel to the wellbore axis, the mandrel is longitudinally shifted relative to the perforator housing along the shaft axis and at least a portion of the penetrator is extended radially outwardly from the perforator housing.

33. The downhole perforator assembly as recited in claim 32 wherein the downhole power unit further comprises a self-contained power source for providing electrical power.

34. The downhole perforator assembly as recited in claim 32 wherein the downhole power unit further comprises:

an electric motor including a rotor; and a jackscrew assembly including a rotational member connected to the rotor, the rotational member operably associated with the moveable shaft to impart motion thereto.

35. The downhole perforator assembly as recited in claim 32 wherein the downhole power unit further comprises a controller that controls the operation of the moveable shaft.

36. The downhole perforator assembly as recited in claim 32 wherein the mandrel is rotatably coupled to the penetrator such that the penetrator rotates and extends radially outwardly relative to the perforator housing when the mandrel is longitudinally shifted relative the perforator housing.

37. A method for perforating a tubular disposed within a wellbore having a substantially longitudinal wellbore axis, the method comprising the steps of:

providing a downhole power unit having a power unit housing, a jackscrew assembly and a moveable shaft;

providing a downhole perforator having a perforator housing, a mandrel and a penetrator;

operably associating the power unit housing with the perforator housing;

operably associating the moveable shaft with the mandrel;

disposing the downhole power unit and downhole perforator in the well;

operating the jackscrew assembly to longitudinally shift the moveable shaft relative to the power unit housing along a shaft axis substantially parallel to the wellbore axis, thereby longitudinally shifting the mandrel relative to the perforator housing along the shaft axis; and responsive to the longitudinal shifting of the mandrel, radially extending at least a portion of the penetrator outwardly from the perforator housing, thereby perforating the tubular.

38. The method as recited in claim 37 wherein the step of activating the downhole power unit further comprises operating timing circuitry to provide a signal to a microcontroller after passage of a predetermined amount of time.

39. The method as recited in claim 37 wherein the step of activating the downhole power unit further comprises operating a pressure-sensitive switch to provide a signal to a microcontroller upon encountering a predetermined amount of pressure.

40. The method as recited in claim 37 wherein the step of activating the downhole power unit further comprises operating a motion sensor to provide a signal to a microcontroller upon encountering a predetermined motion state.

41. The method as recited in claim 37 wherein the step of radial extending at least a portion of the penetrator outwardly from perforator housing further comprises radially outwardly urging the penetrator relative to the perforator housing with a ramp of the mandrel.

42. The method as recited in claim 37 wherein the step of radially extending at least a portion of the penetrator outwardly from perforator housing further comprises rotating the penetrator relative to the mandrel.

43. The method as recited in claim 37 wherein the step of radial extending at least a portion of the penetrator outwardly from perforator housing further comprises rotating the penetrator relative to the perforator housing.

44. The method as recited in claim 37 wherein the step of radial extending at least a portion of the penetrator outwardly from perforator housing further comprises rotating a pair of penetrators relative to the perforator housing.

45. A method f or perforating a tubular disposed within a wellbore having a substantially longitudinal wellbore axis, the method comprising the steps of:

providing a downhole power unit having a power unit housing and a moveable shaft;

providing a downhole perforator having a perforator housing, a mandrel and a penetrator;

operably associating the power unit housing with the perforator housing;

operably associating the moveable shaft with the mandrel;

disposing the downhole power unit and downhole perforator in the well;

activating the downhole power unit to longitudinally shift the moveable shaft relative to the power unit housing along a shaft axis substantially parallel to the wellbore axis, thereby longitudinally shifting the mandrel relative to the perforator housing along the shaft axis; and responsive to the longitudinal shifting of the mandrel, radially extending at least a portion of the penetrator outwardly from the perforator housing by rotating the penetrator, thereby perforating the tubular.

46. The method as recited in claim 45 wherein the step of activating the downhole power unit further comprises operating timing circuitry to provide a signal to a microcontroller after passage of a predetermined amount of time.

47. The method as recited in claim 45 wherein the step of activating the downhole power unit further comprises operating a pressure-sensitive switch to provide a signal to a microcontroller upon encountering a predetermined amount of pressure.

48. The method as recited in claim 45 wherein the step of activating the downhole power unit further comprises operating a motion sensor to provide a signal to a microcontroller upon encountering a predetermined motion state.

49. The method as recited in claim 45 wherein the step of activating the downhole power unit to longitudinally shift the moveable shaft relative to the power unit housing further comprises operating a jackscrew assembly.

50. A downhole perforator assembly for establishing communication between an interior of a tubular disposed within a wellbore having a substantially longitudinal wellbore axis and an annulus around the tubular, the downhole perforator assembly comprising:

a downhole power unit having a power unit housing, a moveable shaft, an electric motor including a rotor and a jackscrew assembly including a rotational member connected to the rotor, the rotational member operably associated with the moveable shaft to impart motion thereto;

an actuator having an actuator housing, an actuator mandrel slidably positioned within the actuator housing and a piston slidably positioned within the actuator housing, the power unit housing operably associated with the actuator housing and the moveable shaft operably associated with the actuator mandrel; and a downhole perforator having a perforator housing, a perforator mandrel slidably positioned within the perforator housing and a penetrator radially outwardly extendable from the perforator housing, the actuator housing operably associated with the perforator housing and the piston operably associated with the perforator mandrel such that when the downhole power unit is activated and the moveable shaft is longitudinally shifted relative to the power unit housing along a shaft axis substantially parallel to the wellbore axis, the piston is longitudinally shifted relative to the actuator housing and the actuator mandrel, thereby longitudinally shifting the perforator mandrel relative to the perforator housing along the shaft axis such that at least a portion of the penetrator is extended radially outwardly from the perforator housing.

51. The downhole perforator assembly as recited in claim 50 wherein the downhole power unit further comprises a controller that controls the operation of the moveable shaft.

52. The downhole perforator assembly as recited in claim 50 wherein the penetrator further comprises a rotatable cutting member.

53. The downhole perforator assembly as recited in claim 50 wherein the perforator mandrel is rotatably coupled to the penetrator such that the penetrator rotates and extends radially outwardly relative to the perforator housing when the perforator mandrel is longitudinally shifted relative the perforator housing.

54. A downhole perforator assembly f or establishing communication between an interior of a tubular disposed within a wellbore having a substantially longitudinal wellbore axis and an annulus around the tubular, the downhole perforator assembly comprising:

a downhole power unit having a power unit housing and a moveable shaft;

an actuator having an actuator housing, an actuator mandrel slidably positioned within the actuator housing and a piston slidably positioned within the actuator housing, the power unit housing operably associated with the actuator housing and the moveable shaft operably associated with the actuator mandrel; and a downhole perforator having a perforator housing, a perforator mandrel slidably positioned within the perforator housing and a rotatable penetrator radially outwardly extendable from the perforator housing, the actuator housing operably associated with the perforator housing and the piston operably associated with the perforator mandrel such that when the downhole power unit is activated and the moveable shaft is longitudinally shifted relative to the power unit housing along a shaft axis substantially parallel to the wellbore axis, the piston is longitudinally shifted relative to the actuator housing and the actuator mandrel, thereby longitudinally shifting the perforator mandrel relative to the perforator housing along the shaft axis such that at least a portion of the penetrator is extended radially outwardly from the perforator housing.

55. The downhole perforator assembly as recited in claim 54 wherein the downhole power unit further comprises a self-contained power source for providing electrical power.

56. The downhole perforator assembly as recited in claim 54 wherein the downhole power unit further comprises:

an electric motor including a rotor; and a jackscrew assembly including a rotational member connected to the rotor, the rotational member operably associated with the moveable shaft to impart motion thereto.

57. The downhole perforator assembly as recited in claim 54 wherein the downhole power unit further comprises a controller that controls the operation of the moveable shaft.

58. The downhole perforator assembly as recited in claim 54 wherein the perforator mandrel is rotatably coupled to the penetrator such that the penetrator rotates and extends radially outwardly relative to the perforator housing when the perforator mandrel is longitudinally shifted relative the perforator housing.

* * * * *